US007643781B2

(12) United States Patent
Sakashita et al.

(10) Patent No.: US 7,643,781 B2
(45) Date of Patent: Jan. 5, 2010

(54) TRANSFER DEVICE AND IMAGE FORMING APPARATUS

(75) Inventors: Takeshi Sakashita, Osaka (JP); Kohji Hatayama, Osaka (JP); Tomofumi Inoue, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 102 days.

(21) Appl. No.: 11/761,794

(22) Filed: Jun. 12, 2007

(65) Prior Publication Data

US 2008/0003022 A1 Jan. 3, 2008

(30) Foreign Application Priority Data

Jun. 28, 2006 (JP) ..... 2006-177576

(51) Int. Cl.
*G03G 15/01* (2006.01)

(52) U.S. Cl. ..... 399/302; 399/299; 399/308

(58) Field of Classification Search ..... 399/297, 399/298, 299, 302, 308
See application file for complete search history.

(56) References Cited

U.S. PATENT DOCUMENTS 6,021,287 A * 2/2000 Tanaka ..... 399/299
6,941,102 B2 * 9/2005 Sasamoto et al. ..... 399/299
7,215,914 B2 5/2007 Murakami et al.
2007/0183816 A1 8/2007 Hatayama et al.

FOREIGN PATENT DOCUMENTS

CN 1609724 A 4/2005
JP 2002-62776 2/2002
JP 3833057 7/2006

OTHER PUBLICATIONS

U.S. Appl. No. 12/125,653, filed May 22, 2008, Inoue, et al.

* cited by examiner

*Primary Examiner*—Stephen F Husar
(74) *Attorney, Agent, or Firm*—Oblon, Spivak, McClelland, Maier & Neustadt, L.L.P.

(57) ABSTRACT

A transfer device transfers an image formed on each of image-carrier rotating members onto a transfer belt by applying a bias voltage to the image-carrier rotating members. A rotation axis of one of image-carrier rotating member located the most upstream is positioned closer to the transfer belt than those of the other image-carrier rotating members. Each of the bias-applying rotating members is displaced downstream of the corresponding image-carrier rotating member, and a line on which a rotation axis of the bias-applying rotating member and that of the corresponding image-carrier rotating member fall is orthogonal to a moving direction of the transfer belt.

10 Claims, 9 Drawing Sheets

TRANSFER DEVICE AND IMAGE FORMING APPARATUS

CROSS-REFERENCE TO RELATED APPLICATIONS

The present document incorporates by reference the entire contents of Japanese priority document, 2006-177576 filed in Japan on Jun. 28, 2006.

BACKGROUND OF THE INVENTION

1. Field of the Invention

The present invention relates to a transfer device that transfers a toner image formed on an image-carrier rotating member onto transfer medium via an intermediate transfer belt.

2. Description of the Related Art

Conventionally, there have been proposed quadruple-tandem type color image forming apparatuses. In such a color image forming apparatus, four photosensitive drums, each of which works as an image-carrier rotating member for carrying a toner image in a specific color corresponding to each of black, cyan, magenta, and yellow, are arranged in a row on a single plane. The toner images formed on the photosensitive drums by a developing unit are transferred, as superimposed on one another (by using an offset method), onto a surface of an intermediate transfer belt by a primary transfer roller corresponding to each of the photosensitive drums. The toner image obtained as a result of the superimposing process is secondarily transferred onto a transfer medium by a secondary transfer roller. Thereafter, the toner image on the transfer medium is fixed by applying a heat and a pressure with a fixing device. Thereby, a color image is obtained.

In such a color image forming apparatus having a single-color mode (for example, monochrome mode) and a full-color mode, to protect the photosensitive drums and the intermediate transfer belt from mechanical tear and wear as much as possible, when the monochrome mode is selected, three primary transfer rollers corresponding to the cyan, magenta, and yellow photosensitive drums, that is, the photosensitive drums other than the black photosensitive drum used at the monochrome mode are detached from the intermediate transfer belt by an attaching/detaching mechanism. In the attaching/detaching mechanism, for example, an end of a linking member pivots on an axis so that the linking member swings around the pivot axis as a supporting point, and the primary transfer roller is arranged on the linking member.

However, when all the photosensitive drums including the photosensitive drum used in the monochrome mode are arranged in a row on a single plane, a distance required for detaching the three primary transfer rollers from the intermediate transfer belt (or a distance required for attaching the three primary transfer rollers to the intermediate transfer belt when the full-color mode is set) becomes large.

The above problem is explained in detail below with reference to FIG. 7. The primary transfer roller C2 for cyan that is positioned in the third place from the most upstream along a moving direction of the intermediate transfer belt (i.e., in a direction of an arrow shown in FIG. 7) moves distance E to detach from the intermediate transfer belt. However, a primary transfer roller Y2 for yellow that is positioned in the most upstream moves distance E', which is approximately three times as large as distance E. This is why it takes a long time until the image forming apparatus becomes ready to transfer, when the image forming apparatus is switched between the monochrome mode and the full-color mode, and it is difficult to reduce a size of a driving motor that drive an attaching/detaching mechanism for attaching or detaching the primary transfer rollers to or from the intermediate transfer belt.

To solve the problems described above, Japanese Patent Application Laid-open No. 2002-62776 discloses a transfer device in which, as shown in FIG. 8, a photosensitive drum Bk1 for black used in the monochrome mode is positioned closer to the intermediate transfer belt than the other three photosensitive drums C1, M1, and Y1 used in the full-color mode are. In other words, a rotation axis of the photosensitive drum Bk1 for black (on plane B indicated by a solid line shown in FIG. 8) is positioned closer to the intermediate transfer belt and displaced from a plan on which rotation axes of the other photosensitive drums C1, M1, and Y1 for the color use fall (plan A indicated by a dashed line shown in FIG. 8). According to the above technique, the largest distance required for detaching the primary transfer rollers from the intermediate transfer belt is distance E", which is significantly smaller than distance E' shown in FIG. 6.

However, the technique disclosed in Japanese Patent Application Laid-open No. 2002-62776 still has a problem where a width of a portion of the intermediate transfer belt in contact with the photosensitive drum used in the monochrome mode differs depending on whether the primary transfer rollers corresponding to the three photosensitive drums used at the color mode are detached from the intermediate transfer belt. More specifically, as shown in FIG. 9, when the full-color mode is selected, that is, when the primary transfer rollers C2, M2, and Y2 are in contact with the intermediate transfer belt and are opposite to the photosensitive drums C1, M1, and Y1 used at the full-color mode, a contact angle that indicates the width of the portion of the photosensitive drum Bk1 for black in contact with the intermediate transfer belt is angle θ1 as shown with a solid line in FIG. 9. When the monochrome mode is selected, and the primary transfer rollers C2, M2, and Y2 opposite to the photosensitive drums C1, M1, and Y1 used in the full-color mode are detached from the intermediate transfer belt, the contact angle is angle θ2 as shown with a broken line in FIG. 9. It means that, the width of the portion of the intermediate transfer belt in contact with the photosensitive drum Bk1 changes (θ1>θ2). As a result, because the conditions under which an image is transferred from the photosensitive drum Bk1 set to be used in the monochrome mode onto the intermediate transfer belt differs depending on which mode is selected, the quality of the image also varies.

SUMMARY OF THE INVENTION

It is an object of the present invention to at least partially solve the problems in the conventional technology.

According to an aspect of the present invention, a transfer device that transfers an image formed on each of a plurality of image-carrier rotating members onto a transfer belt by applying a bias voltage to image-carrier rotating members, the image-carrier rotating members including a first image-carrier rotating member that is located most upstream along a moving direction of the transfer belt, the transfer device includes a bias-applying rotating member corresponding to each of the image-carrier rotating member, each of the bias-applying rotating member being positioned opposite to a corresponding one of the image-carrier rotating members, the transfer belt being interposed between the bias-applying rotating member and the corresponding image-carrier rotating member, and the bias-applying rotating member configured to apply a bias voltage to the transfer belt whereby the image formed on the corresponding image-carrier rotating member is transferred onto the transfer belt, wherein the first image-carrier rotating member is arranged so that a rotation axis of the first image-carrier rotating member is positioned closer to the transfer belt and displaced from a line on which rotation axes of other image-carrier rotating members fall, and each of the bias-applying rotating members being displaced downstream of the corresponding image-carrier rotating member along the moving direction of the transfer belt, and a line on which a rotation axis of each of the bias-applying rotating member and a rotation axis of the corresponding image-carrier rotating member fall is orthogonal to the moving direction of the transfer belt.

According to another aspect of the present invention, an image forming apparatus includes the above transfer device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

Figure 1:
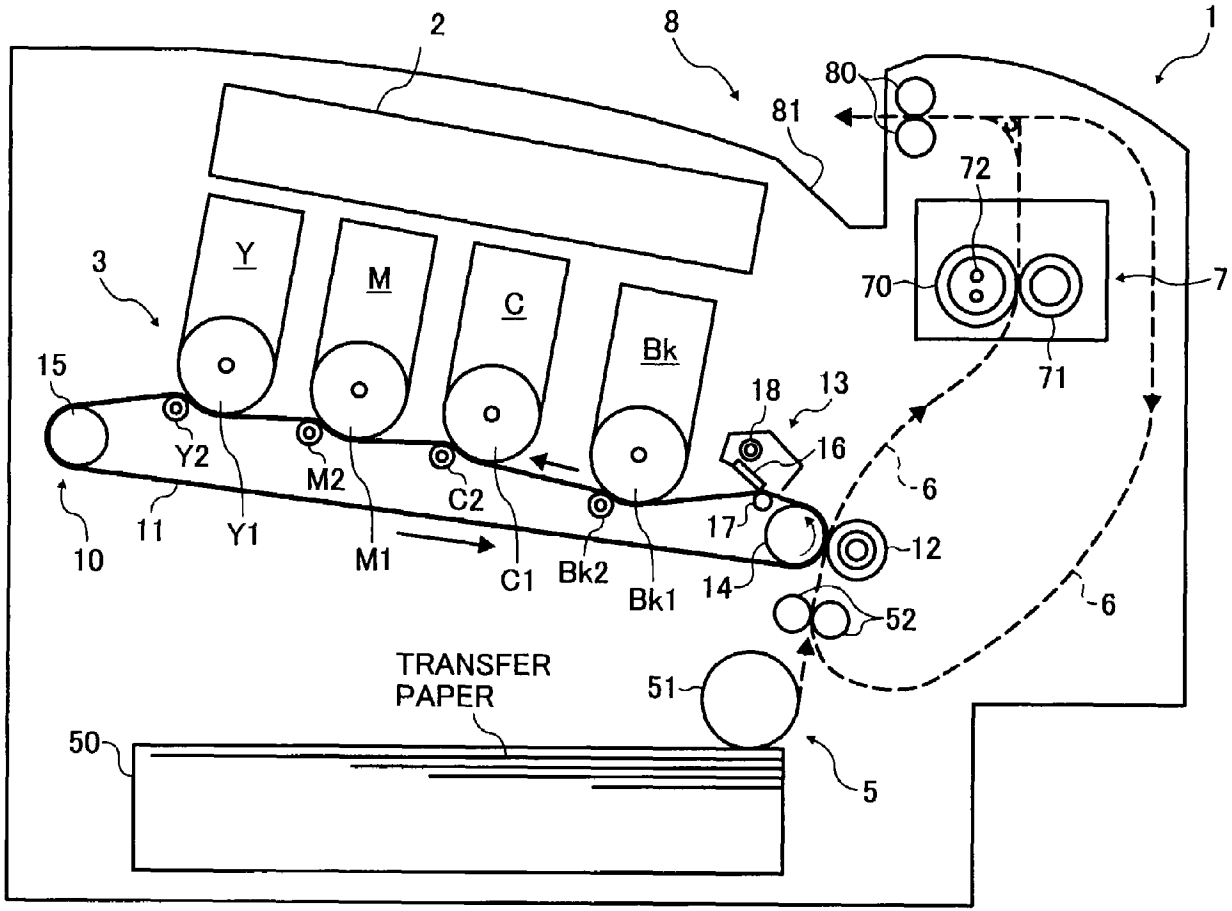
FIG. 1 is a side view for explaining an overall configuration of a quadruple-tandem type color image forming apparatus according to an embodiment of the present invention.
Figure 2:
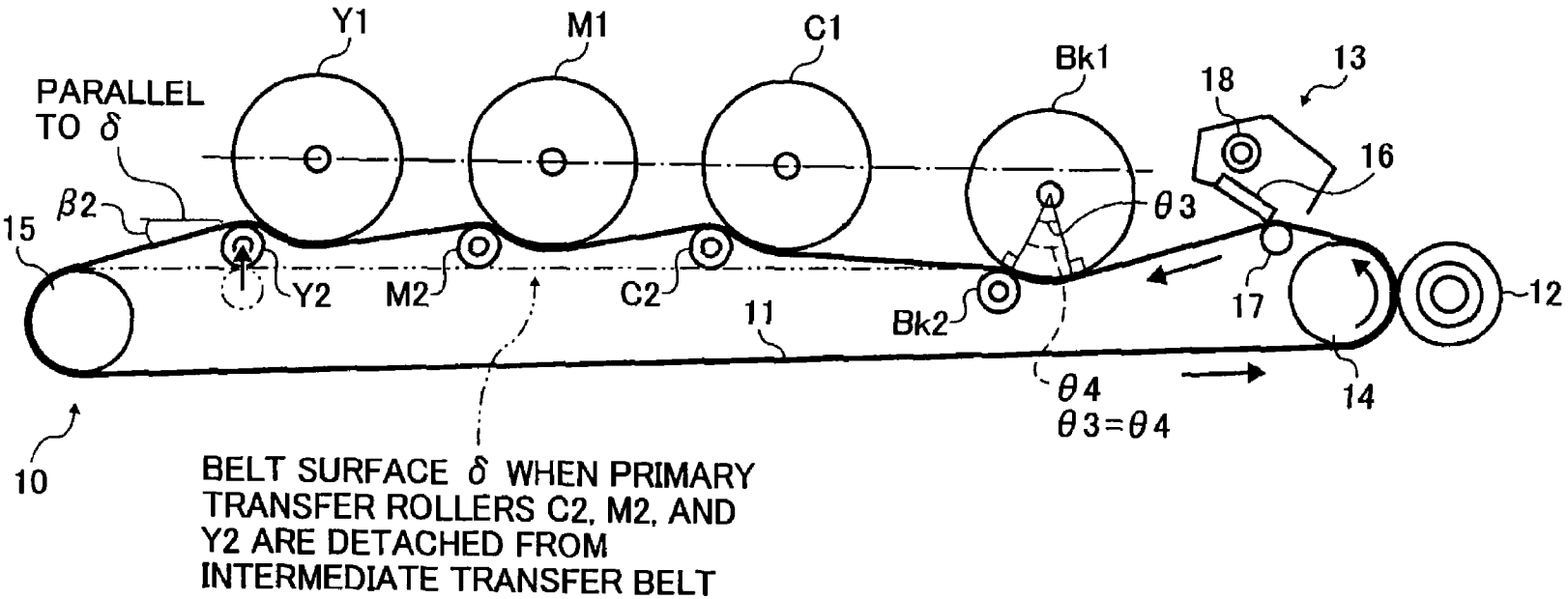
FIG. 2 is a side view of for explaining a configuration of a transfer device shown in FIG. 1 when a full-color mode is selected.
Figure 3:
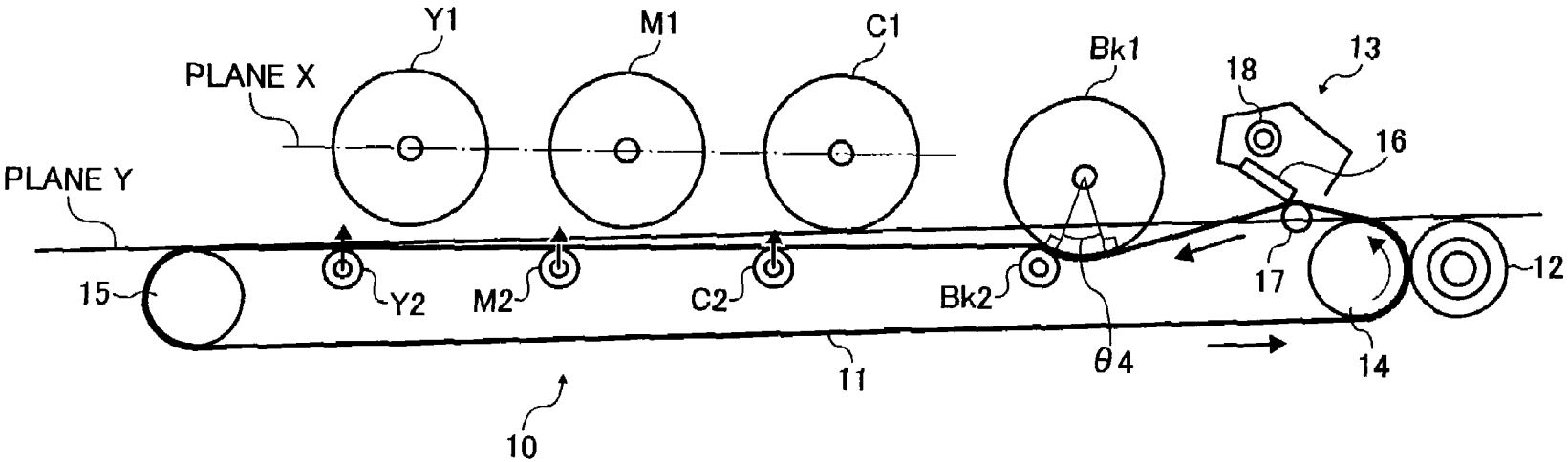
FIG. 3 is a side view of the transfer device when a monochrome mode is selected.

FIG. 1 is a side view for explaining an overall configuration of a quadruple-tandem type color image forming apparatus as an example of an image forming apparatus. FIG. 2 is a side view for explaining a configuration of a transfer device shown in FIG. 1, when a full-color mode is selected. FIG. 3 is a side view for explaining the configuration of the transfer device shown in FIG. 2, when a monochrome mode is selected.

In FIG. 1, the reference numeral 1 denotes a color image forming apparatus. The color image forming apparatus 1 includes an optical system 2, an image forming device 3, a paper supplying unit 5, a conveying path 6, a fixing unit 7, and a paper ejecting unit 8. The image forming device 3 includes four image forming units Bk, C, M, and Y and a transfer device 10. Each of the four image forming units Bk, C, M, and Y has a single specific toner selected from among black, cyan, magenta, and yellow and develops a latent toner image. The transfer device 10 firstly transfers the toner images in the single specific color developed by the image forming units Bk, C, M, and Y so that the toner images are superimposed on one another, and then transfers the superimposed toner image onto a transfer medium such as copy paper.

The transfer device 10 includes four photosensitive drums Bk1, C1, M1, and Y1, an intermediate transfer belt 11, four primary transfer rollers Bk2, C2, M2, and Y2 each of which corresponds to the photosensitive drums Bk1, C1, M1, and Y1 and applies a bias voltage to a corresponding one of the photosensitive drums Bk1, C1, M1, and Y1, and a cleaning unit 13 that cleans the intermediate transfer belt 11. The photosensitive drums Bk1, C1, M1, and Y1 are incorporated with the image forming units Bk, C, M, and Y, respectively in a process cartridge.

When a monochrome mode is selected, out of the photosensitive drums Bk1, C1, M1, and Y1, only the photosensitive drum Bk1 is used, that is, an image is developed by using only the image forming unit Bk. In other words, when the monochrome mode is selected, only the image forming unit Bk and the corresponding photosensitive drum Bk1 operate to form a black-and-white image. However, another arrangement is also acceptable in which, any one of the other photosensitive drums C1, M1, and Y1 is set to be used in the monochrome mode to form a single-colored image in the corresponding specific color. The toner image is formed, as a resultant of this case, which is in the single specific color corresponding to the image forming unit that is set to be used in the monochrome mode.

As shown in FIGS. 2 and 3, the rotation axis of the photosensitive drum Bk1 that is set to be used in the monochrome mode is positioned closer to the intermediate transfer belt 11 than the rotation axes of the other photosensitive drums C1, M1, and Y1, those set to be used in the full-color mode. The photosensitive drum Bk1 is located the most upstream side along a moving direction of the intermediate transfer belt 11, among all of the photosensitive drums Bk1, C1, M1, and Y1.

The intermediate transfer belt 11 is an endless belt member and is bridged by a driving roller 14 and a driven roller 15. The intermediate transfer belt 11 is driven by the driving roller 14 to rotate in a direction indicated by arrow shown in FIGS. 1 to 6. Each of primary transfer rollers Bk2, C2, M2, and Y2 corresponding to each of the photosensitive drums Bk1, C1, M1, and Y1 is positioned opposite to the corresponding one of the photosensitive drums Bk1, C1, M1, and Y1, and the intermediate transfer belt 11 is interposed between the primary transfer rollers Bk2, C2, M2, and Y2 and the photosensitive drums Bk1, C1, M1, and Y1. A secondary transfer roller 12 is positioned opposite to the driving roller 14 while the intermediate transfer belt 11 is interposed between the secondary transfer roller 12 and the driving roller 14. A bias supply (not shown) is connected to each of the primary transfer rollers Bk2, C2, M2, and Y2 and to the secondary transfer roller 12, so that a bias voltage can be applied.

Out of the primary transfer rollers Bk2, C2, M2, and Y2, the primary transfer rollers C2, M2, and Y2 that are set to be used in the full-color mode can be attached to or detached from the intermediate transfer belt 11 by an attaching/detaching mechanism (not shown) by using a conventional technique. When the full-color mode is selected, the primary transfer rollers C2, M2, and Y2 move, from the state shown in FIG. 3 corresponding to the monochrome mode, in a direction indicated with arrow to attach to the intermediate transfer belt 11 as shown in FIG. 2. While being pushed and stretched, a portion of the intermediate transfer belt 11 is in contact with each of the photosensitive drums C1, M1, and Y1. A portion of the intermediate transfer belt 11 is in contact with the primary transfer roller Bk2 that is set to be used in the monochrome mode without involved in an operation by the attaching/detaching mechanism.

Each of the primary transfer rollers Bk2, C2, M2, and Y2 is positioned displaced downstream of the corresponding one of the photosensitive drums Bk1, C1, M1, and Y1. Also, the primary transfer rollers Bk2, C2, M2, and Y2 along the moving direction of the intermediate transfer belt 11 indicated by the arrow, and is overlapped with the corresponding one of the photosensitive drums Bk1, C1, M1, and Y1 orthogonally to the moving direction of the intermediate transfer belt 11. In other words, the rotation axis of each of the primary transfer rollers Bk2, C2, M2, and Y2 is positioned displaced downstream of the rotation axis of the corresponding one of the photosensitive drums Bk1, C1, M1, and Y1. Moreover, a line on which the rotation axes of each the primary transfer rollers Bk2, C2, M2, and Y2 and the rotation axis of the corresponding one of the photosensitive drums Bk1, C1, M1, and Y1 fall is orthogonal to the moving direction of the intermediate transfer belt 11. Still moreover, an outer circumference of each of the primary transfer rollers Bk2, C2, M2, and Y2, and an outer circumference of the corresponding one of the photosensitive drums Bk1, C2, M1, and Y1 are in contact with a portion of the intermediate transfer belt 11 and are overlapped with each other when viewed from the moving direction of the intermediate transfer belt 11. As a result, the intermediate transfer belt 11 can be in contact with each of the photosensitive drums Bk1, C1, M1, and Y1 with a portion having an enough width for performing the offset transfer process, that is, it is possible to apply sufficient electric charges required in performing the offset transfer process, from the primary transfer rollers Bk2, C2, M2, and Y2 to the photosensitive drums Bk1, C1, M1, and Y1, via the intermediate transfer belt 11.

As shown in FIG. 3, a plane X is a plane on which the rotation axes of the photosensitive drums C1, M1, and Y1 fall, except the rotation axis of the photosensitive drum Bk1 set to be used in the monochrome mode. A plane Y is a plane that is positioned closest to the photosensitive drums C1, M1, and Y1 among planes that are in contact with both of the outer circumferential surface of the driving roller 14 and the outer circumferential surface of the driven roller 15 that bridge the intermediate transfer belt 11. When the intermediate transfer belt 11 is in the monochrome mode, the plane X and the plane Y are faced to each other in such a manner that a distance between the plane X and the plane Y becomes slightly larger as moving downstream along the moving direction of the intermediate transfer belt 11.

The cleaning unit 13 includes a cleaning blade 16, a roller 17 that positioned opposite to the cleaning blade 16 while the intermediate transfer belt 11 is interposed between the cleaning blade 16 and the roller 17, and a toner conveying screw 18. The cleaning blade 16 and the roller 17 can be attached to or detached from the intermediate transfer belt 11. The roller 17 is positioned slightly upstream of the photosensitive drum Bk1 that is set to be used in the monochrome mode along the moving direction of the intermediate transfer belt 11, capable of obtaining a portion having a predetermined width in contact with the intermediate transfer belt 11 in either the monochrome mode or the full-color mode.

The paper supplying unit 5 includes a paper cassette 50 that stores transfer paper therein and a paper feeding roller 51. The fixing unit 7 includes a fixing roller 70 and a pressure applying roller 71. The fixing roller 70 includes a resistance heating element 72 inside. The paper ejecting unit 8 includes a pair of paper ejecting rollers 80 and a paper catch tray 81.

An operation according to the present embodiment is explained. Firstly, the image forming device 3 forms electrostatic latent images by selectively having the charged photosensitive drums Bk1, C1, M1, and Y1 exposed to light by using the optical system 2. Each of the electrostatic latent images is developed with the toner in the specific color corresponding to each of the image forming units Bk, C, M, and Y, to form a single-color toner image. Then, the photosensitive drums Bk1, C1, M1, and Y1 each of which carries one of the toner images in the predetermined color are sequentially placed, in the order of Bk, C, M, and Y from the most upstream along the moving direction of the intermediate transfer belt 11, in contact with a portion of the intermediate transfer belt 11 that is pulled and stretched by the corresponding one of the primary transfer rollers Bk2, C2, M2, and Y2. Bias voltages are applied by the primary transfer rollers Bk2, C2, M2 and Y2, so that the single-color toner images are transferred, as superimposed on one another, onto the surface of the intermediate transfer belt 11 by using the offset method. As a result, a full-color toner image is formed on the surface of the intermediate transfer belt 11.

The transfer paper stored in the paper cassette 50 is fed one by one by the paper feeding roller 51. A resist roller 52 adjusts a timing of feeding the transfer paper. The paper is conveyed to a transfer nip between the intermediate transfer belt 11 on the driving roller 14 and the secondary transfer roller 12. At the transfer nip, the toner image formed by the image forming device 3 is transferred from the intermediate transfer belt 11 onto the transfer paper by applying the bias voltage with the secondary transfer roller 12. Subsequently, the paper is conveyed to the fixing unit 7 via the conveying path 6. The fixing unit 7 fixes the image transferred on the transfer paper by applying heat and pressure with a nip between the fixing roller 70 and the pressure applying roller 71 heated to a predetermined temperature by the resistance heating element 72. After moving through the conveying path 6, the transfer paper is ejected by the pair of paper ejecting rollers 80 included in the paper ejecting unit 8 and cached on the paper catch tray 81.

The operation of the transfer device 10 is explained in detail. When the full-color mode is selected, the primary transfer rollers C2, M2, and Y2 being in the monochrome mode shown in FIG. 3 are moved by the attaching/detaching mechanism toward outside of the intermediate transfer belt 11 in a direction indicated by an arrow shown in FIG. 3. Each of the primary transfer rollers C2, M2, and Y2 pushes and stretches the intermediate transfer belt 11 to place a portion of the intermediate transfer belt 11 in contact with the corresponding one of the photosensitive drums C1, M1, and Y1. As a result, as shown in FIG. 2, it is ready to perform an offset transfer process. When the mode is switched to the full-color mode, the primary transfer roller Bk2 corresponding to the photosensitive drum Bk1 does not move and keeps the position in the monochrome mode. In other words, the primary transfer roller Bk2 keeps in contact with the photosensitive drum Bk1 via the intermediate transfer belt 11.

In the full-color mode, images are sequentially transferred onto the intermediate transfer belt 11 by applying the bias voltage with the primary transfer rollers Bk, C2, M2, and Y2, while the intermediate transfer belt 11 rotates. More specifically, images in black, cyan, magenta, and yellow are transferred with the primary transfer rollers Bk2, C2, M2, and Y2, respectively. After the primary transfer ends, the intermediate transfer belt 11 keeps rotating for a secondary transfer.

When the monochrome mode is selected, the primary transfer rollers C2, M2, and Y2 being in the full-color mode shown in FIG. 2 are moved by the attaching/detaching mechanism toward inside of the intermediate transfer belt 11 (the solid line shown in FIG. 2 indicating the position of the intermediate transfer belt 11 in the full-color mode, and the dashed line indicating the position of the intermediate transfer belt 11 in the monochrome mode). As a result, as shown in FIG. 3, the intermediate transfer belt 11 is detached from the photosensitive drums C1, M1, and Y1. When the mode is switched to the monochrome mode, the primary transfer roller Bk2 corresponding to the photosensitive drum Bk1 does not move keeps the position in the full-color mode. In other words, the primary transfer roller Bk2 keeps in contact with the photosensitive drum Bk1 via the intermediate transfer belt 11.

In the monochrome mode is selected, only an image in black is transferred onto the intermediate transfer belt 11 by applying the bias voltage with the bias voltage the primary transfer roller Bk2. After that, the intermediate transfer belt 11 keeps rotating for the secondary transfer. Because the other primary transfer rollers, C2, M2, and Y2 does not apply the bias voltage, the three images other than the image in black are not transferred onto the intermediate transfer belt 11.

Figure 4:
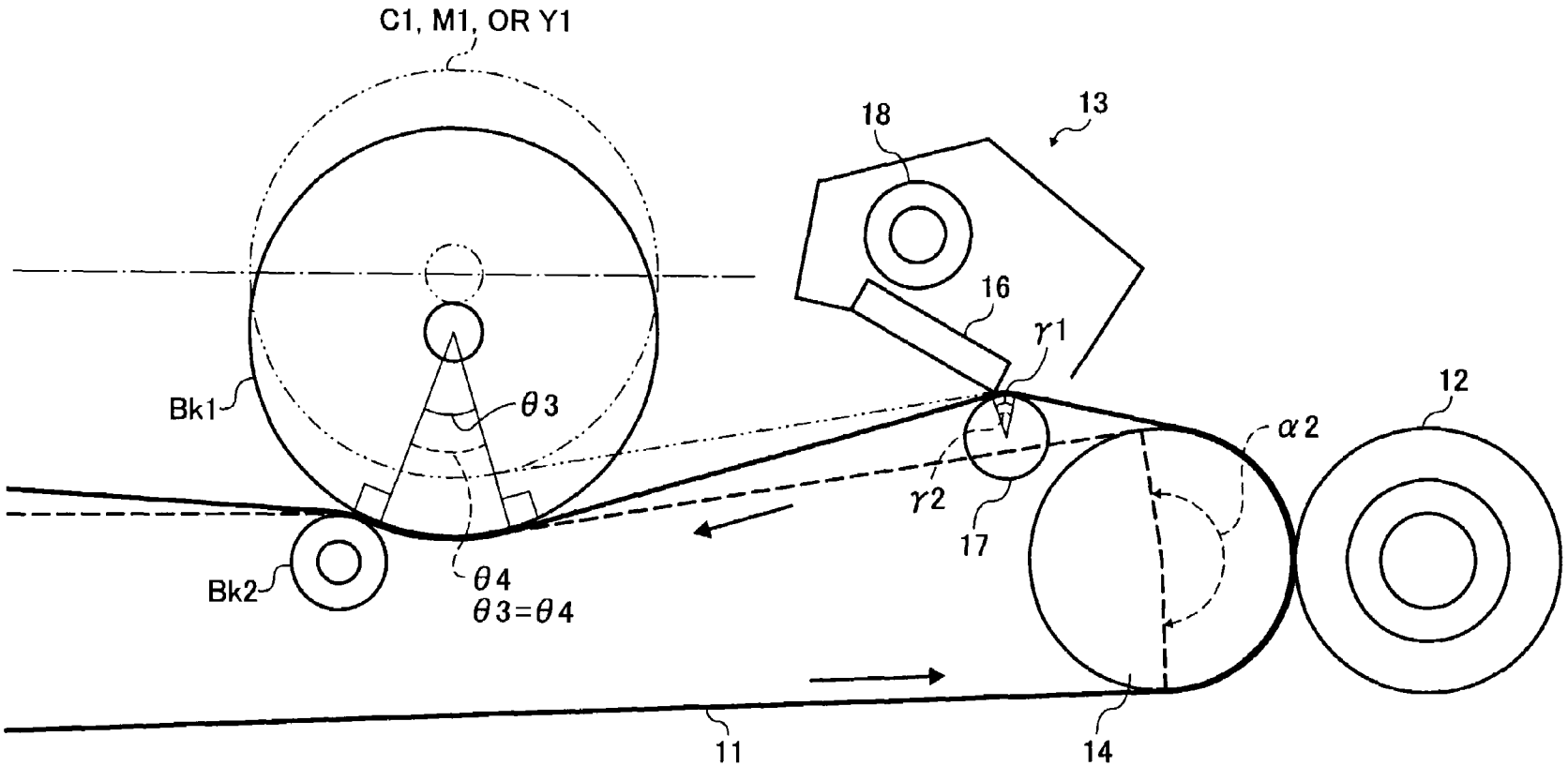
FIG. 4 is an enlarged view of the transfer device shown in FIG. 3 for explaining a width of a portion of a photosensitive drum in contact with an intermediate transfer belt, and a width of a portion of a roller positioned opposite to a cleaning blade in contact with the intermediate transfer belt.
Figure 9:
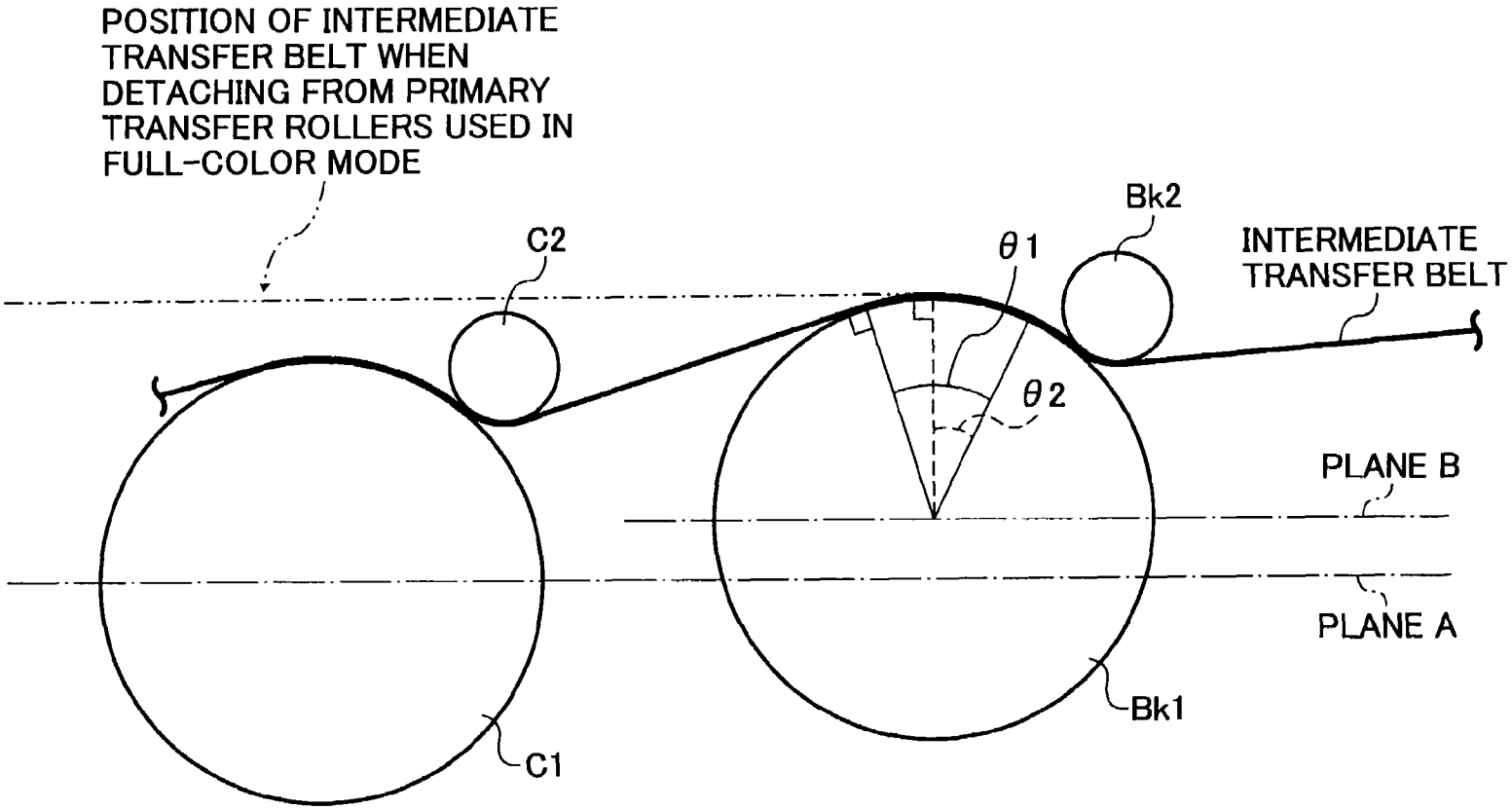
FIG. 9 is an enlarged view of the intermediate transfer belt shown in FIG. 8 for explaining a width of a portion of a photosensitive drum in contact with an intermediate transfer belt.

As explained above, in either the full-color mode or the monochrome mode, as shown in FIG. 4, the rotation axis of the photosensitive drum Bk1 that is set to be used in the monochrome mode is positioned closer to the intermediate transfer belt 11 than the rotation axes of the other photosensitive drums C1, M1, and Y1 used in the color mode are. In addition, the photosensitive drum Bk1 is positioned the most upstream along the moving direction of the intermediate transfer belt 11 among all of the photosensitive drums Bk1, C1, M1, and Y1. Because each of the primary transfer rollers Bk2, C2, M2, and Y2 is positioned displaced downstream of the corresponding one of the photosensitive drums Bk1, C1, M1, and Y1, the contact angle that indicates the width of the portion of the photosensitive drum Bk1 for black in contact with the intermediate transfer belt 11 does not change. More specifically, in the conventional transfer device as shown in FIG. 9, the contact angle $\theta 1$ in a state of the primary transfer rollers C2, M2, and Y2 used in the full-color mode are in contact with the intermediate transfer belt 11 is not equal to angle $\theta 2$ in a state of the primary transfer rollers C2, M2, and Y2 are detached from the intermediate transfer belt 11 ($\theta 1 > \theta 2$). On the other hand, in the transfer device 10 as shown in FIG. 4, the contact angle $\theta 3$ in a state of the primary transfer rollers C2, M2, and Y2 used in the full-color mode are in contact with the intermediate transfer belt 11 is equal to angle $\theta 4$ in a state of the primary transfer rollers C2, M2, and Y2 are detached from the intermediate transfer belt 11 ($\theta 3 = \theta 4$). Consequently, it is possible to keep the quality of the images in constant in either the full-color mode or the monochrome mode, and transfer the image with the constant quality unlike the conventional image with inconstant quality.

Figure 5:
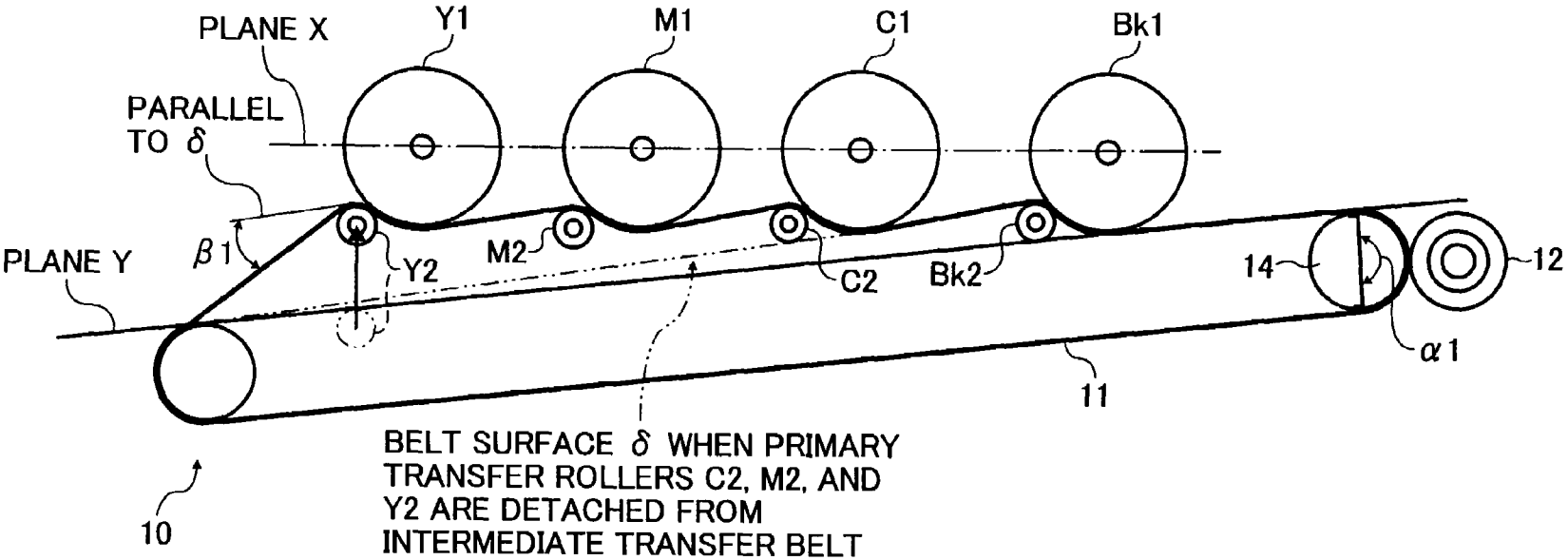
FIG. 5 is a side view of for explaining a configuration of another transfer device for contrasting to the transfer device shown in FIG. 1.
Figure 6:
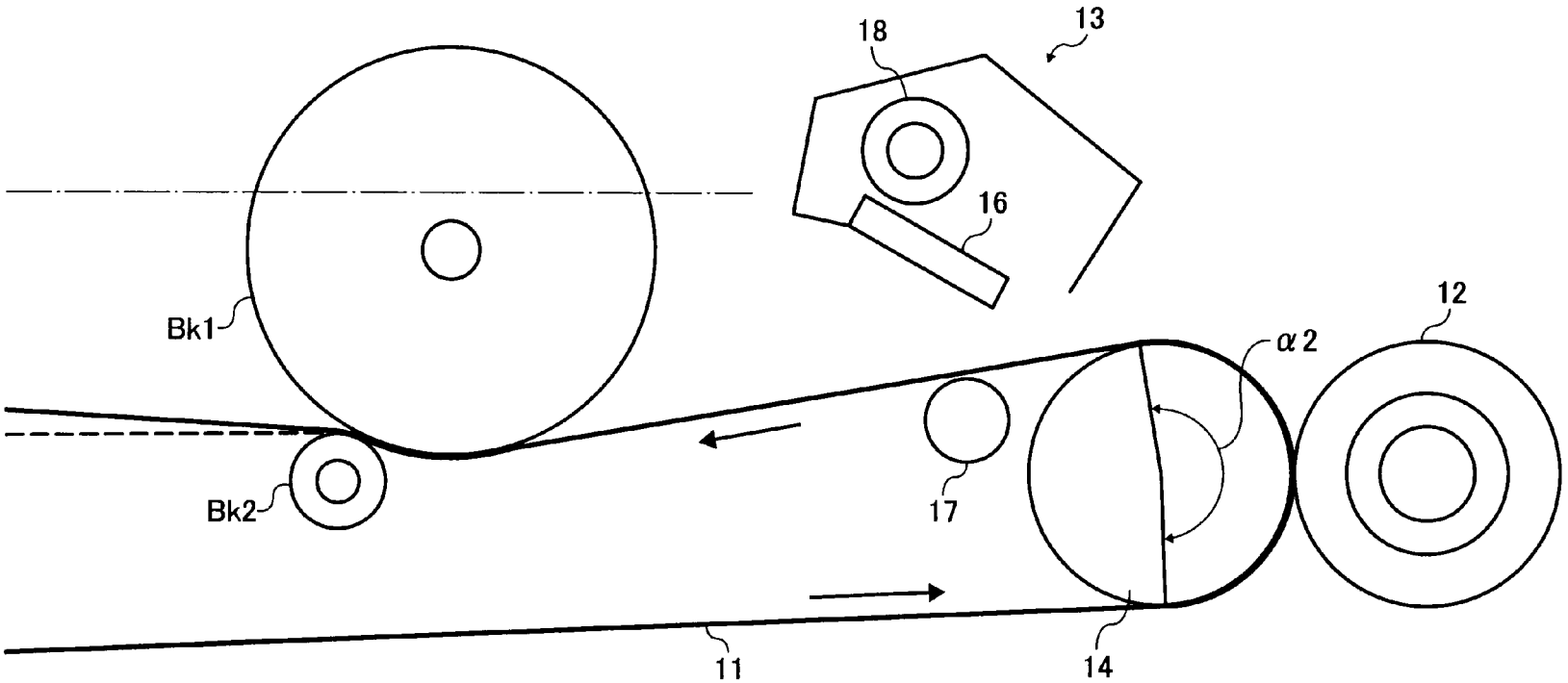
FIG. 6 is an enlarged view of an intermediate transfer belt focusing on an end portion having a cleaning unit.
Figure 7:
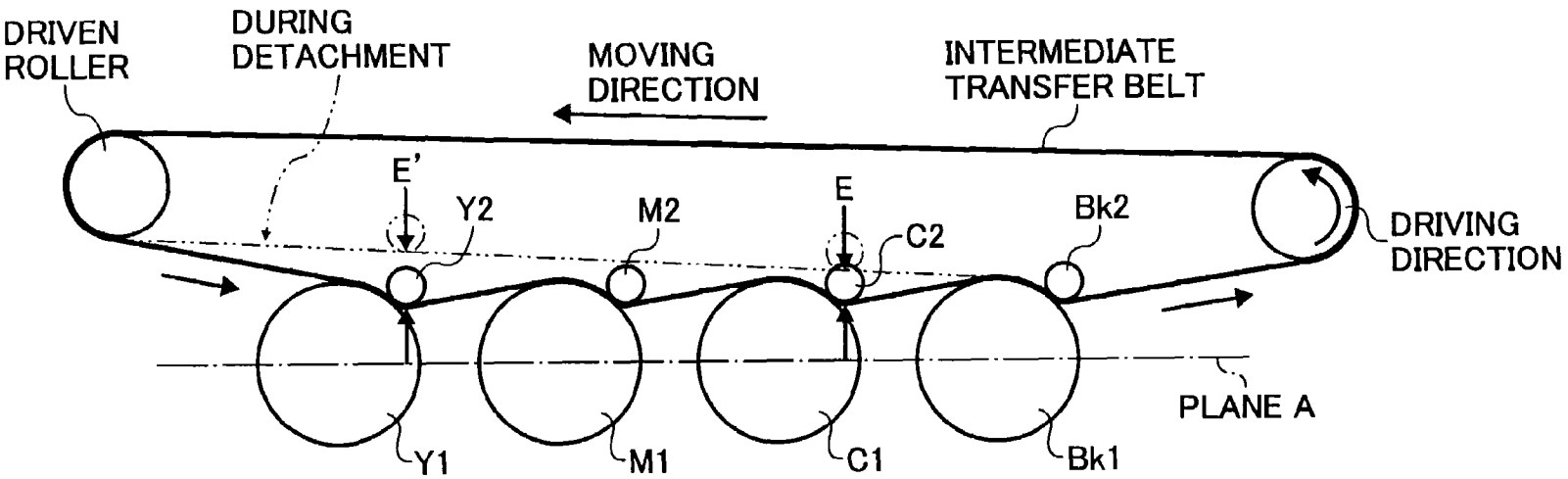
FIG. 7 is a side view for explaining a configuration of a transfer device according to a conventional technique.
Figure 8:
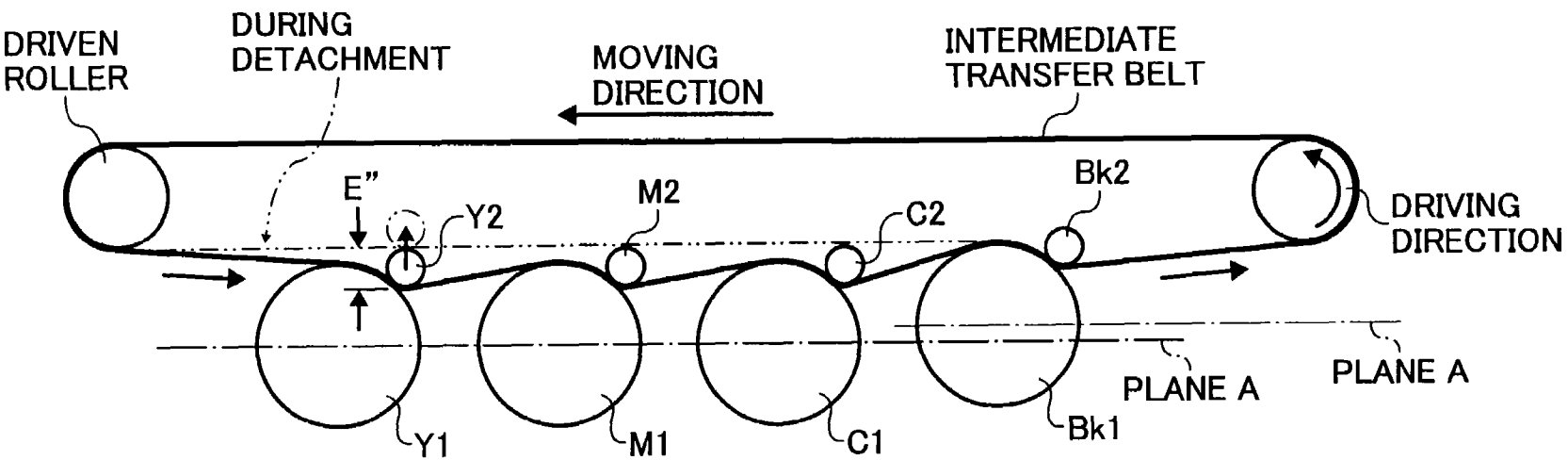
FIG. 8 is a side view for explaining a transfer device according to another conventional technique.

Moreover, according to the present embodiment, because the photosensitive drum Bk1 that is set to be used in the monochrome mode and is positioned closer to the intermediate transfer belt 11 is located immediately downstream of the driving roller 14, a contact angle that indicates a width of the portion of the driving roller 14 in contact with the intermediate transfer belt 11 becomes larger. As shown in FIG. 5, if the photosensitive drum Bk1 set to be used in the monochrome mode is not positioned closer to the intermediate transfer belt 11, that is, the rotation axis of the photosensitive drum Bk1 is positioned on a line on which the rotation axes of the other photosensitive drums C1, M1, and Y1 used in the full-color mode fall, the contact angle that indicates the width of the portion of the driving roller 14 in contact with the intermediate transfer belt 11 is angle a1. On the other hand, according to the present embodiment as shown in FIG. 6, the contact angle that indicates the width of the portion of the driving roller 14 in contact with the intermediate transfer belt 11 is angle a2, which is larger than angle a1. As a result, because the width of the portion of the driving roller 14 in contact with the intermediate transfer belt 11 becomes larger, the force by the driving roller 14 to grip the intermediate transfer belt 11 is improved, which makes it possible to smoothly transfer images preventing the intermediate transfer belt 11 from slipping.

Furthermore, the plane X and the plane Y are faced to each other in such a manner that a distance between the plane X and the plane Y becomes slightly larger as moving downstream along the moving direction of the intermediate transfer belt 11. This makes it possible to reduce the distance required for detaching the primary transfer roller Y2, that is located the most downstream among all the primary transfer rollers Bk2, C2, M2, and Y2, from the intermediate transfer belt 11. The distance for the primary transfer roller Y2 is the largest among the distances for the primary transfer rollers Bk2, C2, M2, and Y2 according to the conventional technique as explained above. As a result, a reaction force that the primary transfer roller Y2 receives from the intermediate transfer belt 11 reacting against a force to push the intermediate transfer belt 11 to be placed in contact with the primary transfer roller Y2 becomes smaller, too. In other words, in the transfer device as shown in FIG. 5 (in which an angle at which the plane X intersects with the plane Y is large), an angle between a belt surface $\delta$ (shown with a broken line in FIG. 5) of the intermediate transfer belt 11 before the primary transfer roller Y2 pushes up the intermediate transfer belt 11 and a belt surface (indicated by a solid line in FIG. 5) of the intermediate transfer belt 11 after the primary transfer roller Y2 is pushed up the intermediate transfer belt 11 is angle $\beta 1$. On the other hand, according to the present embodiment, angle $\beta 2$ corresponding to angle $\beta 1$ is smaller than $\beta 1$ ($\beta 1 > \beta 2$). It means that the reaction force received from the intermediate transfer belt 11 is also smaller.

Moreover, the roller 17 of the cleaning unit 13 is positioned immediately upstream of the photosensitive drum Bk1 set to be used in the monochrome mode along the moving direction of the intermediate transfer belt 11, and the rotation axis of the photosensitive drum Bk1 is positioned closer to the intermediate transfer belt 11 than the rotation axes of the other photosensitive drums C1, M1, and Y1 used in the full-color mode. This is why a contact angle $\gamma 1$ (indicated by a solid line in FIG. 4) that indicates a width of a portion of the roller 17 in contact with the intermediate transfer belt 11 is larger than a contact angle $\gamma 2$ (indicated by a dashed line in FIG. 4) in a case of the roller 17 is positioned immediately upstream of the photosensitive drum C1, M1, or Y1. In other words, the width of the portion of the roller 17 in contact with the intermediate transfer belt 11 becomes larger, that is, the area of the intermediate transfer belt 11 in contact with the cleaning blade 16 is larger. This makes it possible to improve the cleaning effect of the cleaning unit 13.

According to the present embodiment, the primary transfer roller Bk2 corresponding to the photosensitive drum Bk1 does not move to be attached to and detached from the intermediate transfer belt 11, and always keeps in contact with the intermediate transfer belt 11. However, it is acceptable that the primary transfer roller Bk2 is detached from the intermediate transfer belt 11 as necessary, for example, when the electric power is turned off. Also, although a quadruple-tandem type color image forming apparatus is explained as an example, any type of color image forming apparatuses can be applied that switches the mode between the monochrome mode and the full-color mode automatically or manually, and includes a plurality of image forming units including an image forming unit used in the monochrome mode. Furthermore, the shapes and the structures of the constituent elements shown in the drawings are only examples. Various design changes and modifications can be made without departing from the scope of claims.

According to an embodiment of the present invention, in the transfer device, each of the bias-applying rotating members is positioned displaced downstream of the corresponding one of the image-carrier rotating members along the moving direction of the intermediate transfer belt. Also, a line on which the rotation axis the bias-applying rotating members and the corresponding one of the image-carrier rotating members is orthogonal to the moving direction of the intermediate transfer belt. One of the image-carrier rotating members located the most upstream among all the image-carrier rotating members (hereinafter, "first image-carrier rotating member") is used in both the monochrome mode and the full-color mode. These make it possible that the contact angle that indicates the width of the portion of the first image-carrier rotating member in contact with the intermediate transfer belt does not differ either in the full-color mode or in the monochrome mode. Consequently, an advantageous effect is expected where it is possible to transfer images with a constant quality.

Moreover, the angle that indicates the width of the portion of the driving roller in contact with the intermediate transfer belt becomes larger, in other words, the area of the portion of the driving roller in contact with the intermediate transfer belt becomes larger. This makes it possible to improve the force by the driving roller to grip the intermediate transfer belt. Consequently, it is possible to smoothly transfer images preventing the intermediate transfer belt from slipping.

Furthermore, the angle that indicates the width of the portion of the roller opposite to the cleaning blade in contact with the intermediate transfer belt becomes larger, in other words, the area of the portion of the roller in contact with the intermediate transfer belt becomes larger. This makes it possible to improve the cleaning effect of the cleaning unit.

Moreover, it is possible to provide an image forming apparatus that includes the transfer device according to an embodiment of the present invention.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device that transfers an image formed on each of a plurality of image-carrier rotating members onto a transfer belt by applying a bias voltage to image-carrier rotating members, the image-carrier rotating members including a first image-carrier rotating member that is located most upstream along a moving direction of the transfer belt, the transfer device comprising:

a bias-applying rotating member corresponding to each of the image-carrier rotating members, each of the bias-applying rotating members being positioned opposite to a corresponding one of the image-carrier rotating members, the transfer belt being interposed between the bias-applying rotating member and the corresponding image-carrier rotating member, and the bias-applying rotating member configured to apply a bias voltage to the transfer belt whereby the image formed on the corresponding image-carrier rotating member is transferred onto the transfer belt, wherein the first image-carrier rotating member is arranged so that a rotation axis of the first image-carrier rotating member is positioned closer to the transfer belt and displaced from a line on which rotation axes of other image-carrier rotating members fall, each of the bias-applying rotating members being displaced downstream of the corresponding image-carrier rotating member along the moving direction of the transfer belt, and a line on which a rotation axis of each of the bias-applying rotating member and a rotation axis of the corresponding image-carrier rotating member fall is orthogonal to the moving direction of the transfer belt, the first image-carrier rotating member carries an image in a first color, the transfer device further comprising a mechanism that removes the transfer belt from contact with other bias-applying rotating members corresponding to said other image-carrier rotating members to transfer only the image in the first color onto the transfer belt, and a contact angle which corresponds to a width of the transfer belt which is in contact with the first carrier rotating member is constant when the transfer belt is in contact with the other bias-applying rotating members and when the transfer belt is removed from contact with the other bias applying rotating members due to contact of the transfer belt with the bias-applying rotating member that corresponds to the first carrier rotating member.

2. The transfer device according to claim 1, wherein the first color is black.

3. The transfer device according to claim 1, the transfer device further comprising a driving roller that rotatably supports the transfer belt and drives the transfer belt, wherein the driving roller is positioned upstream of the first image-carrier rotating member.

4. The transfer device according to claim 3, further comprising a cleaning unit that cleans residual toner on the transfer belt, wherein the cleaning unit is positioned between the first image-carrier rotating member and the driving roller.

5. The transfer device according to claim 4, wherein the cleaning unit includes a cleaning blade that is in contact with a surface of the transfer belt and a roller that is positioned opposite to the cleaning blade, the transfer belt being interposed between the cleaning blade and the roller, and the roller is positioned upstream of the first image-carrier rotating member.

6. An image forming apparatus comprising a transfer device that transfers an image formed on each of a plurality of image-carrier rotating members onto a transfer belt by applying a bias voltage to the image-carrier rotating members, the image-carrier rotating members including a first image-carrier rotating member that is located most upstream along a moving direction of the transfer belt, the transfer device including a bias-applying rotating member corresponding to each of the image-carrier rotating members, each of the bias-applying rotating members being positioned opposite to a corresponding one of the image-carrier rotating members, the transfer belt being interposed between the bias-applying rotating member and the corresponding image-carrier rotating member, and the bias-applying rotating member configured to apply a bias voltage to the transfer belt whereby the image formed on the corresponding image-carrier rotating member is transferred onto the transfer belt, wherein the first image-carrier rotating member is arranged so that a rotation axis of the first image-carrier rotating member is positioned closer to the transfer belt and displaced from a line on which rotation axes of other image-carrier rotating members fall, each of the bias-applying rotating members being displaced downstream of the corresponding image-carrier rotating member along the moving direction of the transfer belt, and a line on which a rotation axis of each of the bias-applying rotating member and a rotation axis of the corresponding image-carrier rotating member fall is orthogonal to the moving direction of the transfer belt, the first image-carrier rotating member carries an image in a first color, the transfer device further comprising a mechanism that removes the transfer belt from contact with other bias-applying rotating members corresponding to said other image-carrier rotating members to transfer only the image in the first color onto the transfer belt, and a contact angle which corresponds to a width of the transfer belt which is in contact with the first carrier rotating member is constant when the transfer belt is in contact with the other bias-applying rotating members and when the transfer belt is removed from contact with the other bias applying rotating members due to contact of the transfer belt with the bias-applying rotating member that corresponds to the first carrier rotating member.

7. The image forming apparatus according to claim 6, wherein the first color is black.

8. The image forming apparatus according to claim 6, wherein the transfer device further includes a driving roller that rotatably supports the transfer belt and drives the transfer belt, and the driving roller is positioned upstream of the first image-carrier rotating member.

9. The image forming apparatus according to claim 8, wherein the transfer device further includes a cleaning unit that cleans residual toner on the transfer belt, and the cleaning unit is positioned between the first image-carrier rotating member and the driving roller.

10. The image forming apparatus according to claim 9, wherein the cleaning unit includes a cleaning blade that is in contact with a surface of the transfer belt and a roller that is positioned opposite to the cleaning blade, the transfer belt being interposed between the cleaning blade and the roller, and the roller is positioned upstream of the first image-carrier rotating member.

* * * * *